US005965830A

United States Patent [19]

Carlson

[11] Patent Number: 5,965,830

[45] Date of Patent: Oct. 12, 1999

[54] GUITAR NECK INCORPORATING COMBINATION LEVER AND TENSION-COMPRESSION ADJUSTMENT SYSTEM

[75] Inventor: Mark R. Carlson, Minneapolis, Minn.

[73] Assignee: Fender Musical Instruments Corporation, Scottsdale, Ariz.

[21] Appl. No.: 08/866,813

[22] Filed: May 30, 1997

[51] Int. Cl.[6] ..... G10D 3/00

[52] U.S. Cl. ..... 84/293

[58] Field of Search ..... 84/293, 267, 290

[56] References Cited

U.S. PATENT DOCUMENTS

| | | | |
|---|---|---|---|
| 2,148,589 | 2/1939 | Stathopoulo | 84/293 |
| 4,074,606 | 2/1978 | Fender | 84/293 |
| 4,167,133 | 9/1979 | Adams, Jr. | 84/293 |
| 4,203,342 | 5/1980 | Montgomery et al. | 84/293 |
| 4,235,145 | 11/1980 | Adams, Jr. | 84/293 |
| 4,557,174 | 12/1985 | Gressett, Jr. | 84/293 |
| 5,018,423 | 5/1991 | Bunker et al. | 84/293 |
| 5,465,642 | 11/1995 | Goto | 84/293 |

*Primary Examiner*—William M. Shoop, Jr.
*Assistant Examiner*—Shih-yung Hsieh
*Attorney, Agent, or Firm*—Oppenheimer Wolff & Donnelly LLP

[57] ABSTRACT

A guitar neck incorporating a mechanism for adjusting the degree of straightness of the neck's elongated body is provided herein. The mechanism incorporates a lever and tension-compression system to perform the neck adjustment. The lever and tension-compression system includes a platform and a driver connected pivotally to each other in end-to-end relationship. The platform acts as a lever, and the driver creates tension and actuates the lever. The platform and driver are mounted longitudinally of the neck in a groove (slot or passage), the upper and lower wall of which are adjacent to the platform. Pivot points are provided, preferably on the upper and lower walls of the groove, and cooperate with the platform in achieving the proper lever action.

28 Claims, 2 Drawing Sheets

GUITAR NECK INCORPORATING COMBINATION LEVER AND TENSION-COMPRESSION ADJUSTMENT SYSTEM

BACKGROUND OF THE INVENTION

The ultimate goal in design of a guitar neck is to attain and maintain balance on the fine line of playability, without sacrificing sound quality. Playability can be defined as the distance, and thus the finger force, necessary to play (or fret) a note clearly. Of course, the most desired case is the smallest possible string-to-fret distance at all frets along the entire span of the neck.

In attempting to obtain this optimum distance, several challenges have long plagued the industry. A prominent one of these is the annoying fret buzz sound caused by the string slapping against a higher fret as it vibrates in its elliptical path. Depending on the intensity and the direction at which the string is plucked, the amplitude of the string in the direction of the fret will vary. Since each musician's playing technique is different, an ability to adjust the neck is required in order to eliminate buzz and achieve other benefits.

Fret buzz (and related problems) cannot be effectively eliminated in the manufacturing process by simply sanding down the deviant fret until the buzz subsides. Although this is done routinely as a standard part of the manufacturing process, it is a temporary fix. The fix is temporary due to the ever changing forces acting on the neck, and the resulting displacements that occur subsequent to manufacture.

Necks made primarily of wood are desired by a great many guitarists. But the design of wooden necks involves several pitfalls inherent in working with a substance produced by nature. Wood varies in properties from piece to piece. Each log is different, and it is not practical to cut each neck (wood block for a neck) from exactly the same location along the log. There are an infinite number of possible grain angles, distances from center, etc.

Forces acting on the neck, subsequent to manufacture, include varying string-tension forces and further include forces due to expansion and contraction of the wood in response to varying moisture content. Relative to the latter, the cells in the wood exchange moisture with the air until equalization occurs, and expand and contract in so doing. This causes a neck to move significantly, particularly in the case of musicians who travel to different climates over short periods of time.

The conventional way to adjust a guitar neck, to eliminate the results of the above-specified and other forces, is to use a truss rod. Truss rods have existed for decades, but have certain points of ineffectiveness. Typical rods act primarily on the basis of reverse tensioning in order to counteract string forces. However, it is the opinion of applicant that these rods cause unwanted humps along the fingerboard when certain adjustments occur. Such humps are highly undesired because they require an increase in over-all distance between frets and strings in order to prevent fret buzz.

SUMMARY OF THE INVENTION

In accordance with the present invention, tension and leverage are employed in combination with each other in order to yield a substantially even, hump-free, smooth and more efficient neck adjustment.

To achieve leverage, there are provided a platform and a driver connected pivotally to each other in end-to-end relationship. The platform is a lever; the driver creates tension and actuates the lever.

The platform and driver are mounted longitudinally of the neck in a groove (slot or passage), the upper and lower walls of which are adjacent the platform. Pivot points are provided, preferably on the upper and lower walls of the groove, and cooperate with the platform in achieving the proper lever action.

DETAILED DESCRIPTION OF THE PREFERRED EMBODIMENT

The use of the words guitar, guitars, guitarist, above and below (including in the claims) is not limiting. Such words relate also to electric bass guitars, mandolins, banjos, and other such musical instruments that are normally fretted.

A prior-art guitar neck is described and claimed in U.S. Pat. No. 4,557,174. Portions of such patent are hereby incorporated into the present specification as specified below.

Figure 1:
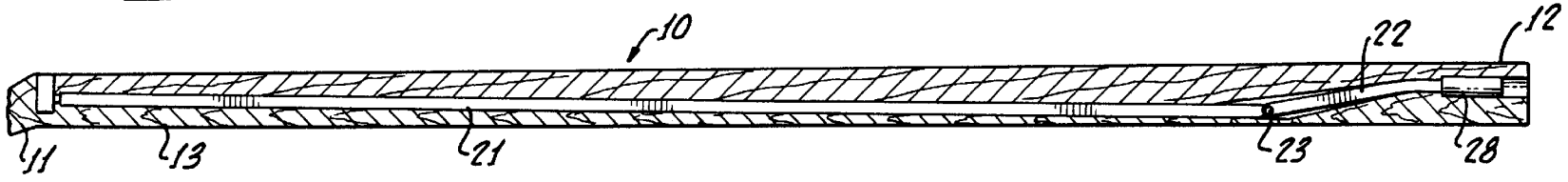
FIG. 1 is a longitudinal schematic view, in vertical central section, of a guitar neck incorporating the present invention.

Referring FIG. 1, there is shown a neck 10 constructed in accordance with the present invention. The head end of the neck is indicated at 11, and the butt end thereof is indicated at 12 (the latter being the neck end that is connected to the guitar body, not shown).

Figure 2:
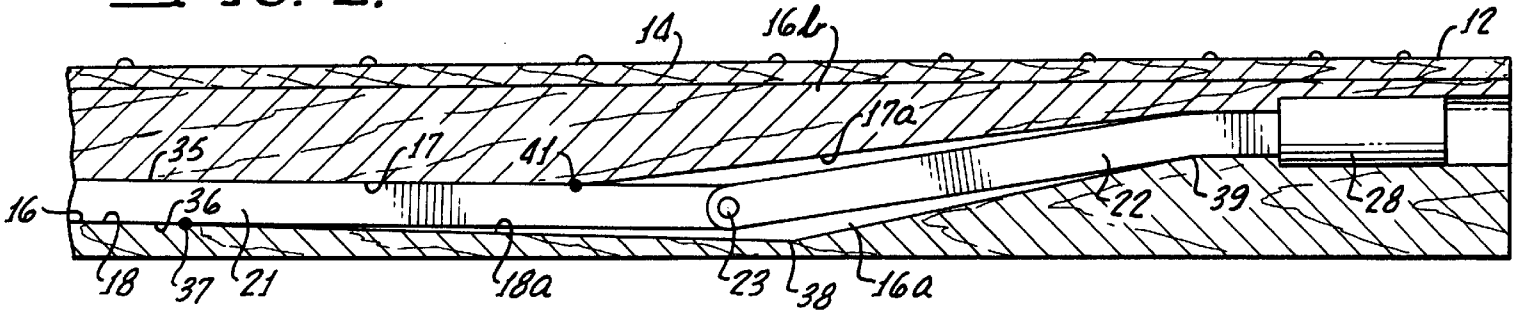
FIG. 2 is an enlarged view of the right end portion of FIG. 1, but with the fingerboard and fillet shown.

The preferred neck is made primarily of wood, having a (typically) maple body 13 and a (typically) rosewood fingerboard (fretboard) 14 (FIG. 2). Other woods that are typical of what may be used are mahogany and maple for the fingerboards. Fingerboard 14 has frets on the upper side thereof; typical frets are shown in the present FIG. 2 and in said U.S. Pat. No. 4,557,174, and the showing thereof is hereby incorporated by reference herein.

Guitar strings (not shown) extend over the frets and over a nut to tuning pegs on the head of the neck.

Formed in neck body 13 in a vertical plane (called the "medial longitudinal plane"), such plane being midway between opposite side edges of the neck body, is a groove (slot) 16. In the present neck, the groove is routed-out and then filled (in part) from above by a glued-in fillet 16*a* (FIG. 2).

Groove 16 has a top wall 17, a bottom wall 18, and parallel side walls 19. Such side walls lie in vertical planes spaced equal distances on opposite sides of the medial longitudinal plane of the neck.

An elongate and substantially rigid platform 21 is mounted in substantially all portions of groove 16 below the fillet 16*a* excepting that portion relatively adjacent the butt end 12 of neck 10. An elongate driver 22 is mounted in the last-indicated portion of groove 16. The right end of platform 21 (as shown in FIG. 2) is adjacent the left end of driver 22. Both the platform 21 and driver 22 are preferably substantially square or rectangular in section, as shown in FIG. 4, and the vertical sides thereof are adjacent the side walls 19 but not sufficiently close thereto to prevent easy movements of the platform and driver 21,22.

Figure 4:
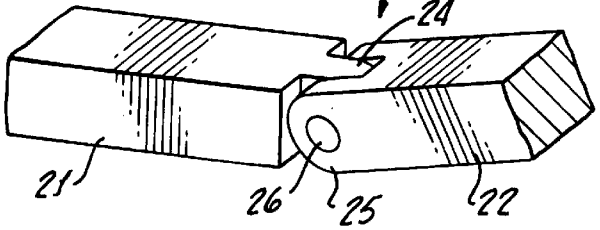
FIG. 4 is a fragmentary isometric view of the hinge portion of the lever system.

A hinge 23, best shown in FIG. 4, connects the adjacent ends of the platform and driver so that vertical pivotal movement may occur. The hinge 23 preferably comprises a tongue 24 and an associated groove 25, both the tongue and groove lying in a vertical plane. A horizontal pivot pin 26 extends through registered holes in the platform and driver, perpendicularly to the longitudinal medial plane. The adjacent ends of platform and driver are so shaped that they may freely pivot relative to each other, in the longitudinal medial plane.

Actuating means, indicated schematically at 28, are disposed in groove 16 at the butt end 12 of neck 10. Such actuating means 28 are manually operable from the butt end to selectively apply major tension or compression to driver 22 and thus to hinge 23 and the adjacent end of platform 21. Actuating means 28 may comprise, for example, the actuating means shown in FIG. 3 of the cited U.S. Pat. No. 4,557,174 and described in the associated specification portion of such patent; both such figure and such specification portion are hereby incorporated by reference herein. When the actuating means of FIG. 3 of the cited patent are employed, the driver end remote from hinge 23 is caused to be cylindrical and is externally threaded for association with the nut illustrated in such FIG. 3 of the cited patent.

Other forms of actuating means may be employed. For example, a worm gear may be associated with driver 22 (at its end remote from hinge 23) in order to apply either tension or compression to the driver and associated elements.

Figure 5B:
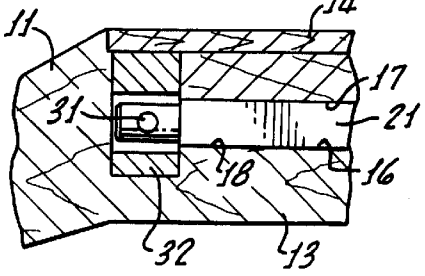
FIG. 5*b* corresponds to FIG. 5*a* but shows a pin connecting to the platform.
Figure 5A:
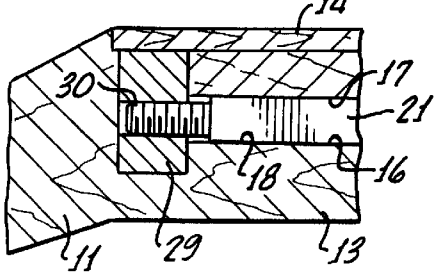
FIG. 5*a* is a vertical central section of the head and of the neck, showing in detail the stop block at such head end.

Referring next to FIG. 5*a,* there is shown the region of platform 21 at the head end 11 of neck 10. A stop block 29 is strongly mounted at the head end of the neck, and has an internally threaded bore therein. Such bore threadedly receives a fastener 30 that threads into or is integral with the extreme head end of the platform.

In a variation shown in FIG. 5*b,* the extreme head end of the platform does not threadedly connect to the block 29. Instead, there is a pin 31 (horizontal, and perpendicular to the medial longitudinal plane) that connects the head end of the platform to a block 32.

Proceeding next to a further description of platform 21, driver 22, it is emphasized that although the platform 21 is substantially rigid, it is normally not so large and massive as to be highly rigid. The purpose is to make the platform 21 sufficiently rigid that it will not bend significantly in response to application to tensile or compressive forces by driver 22 and the associated actuating means 28.

The top platform wall is numbered 35; the bottom platform wall is numbered 36. It is preferred that such top and bottom walls be substantially straight, and that the top and bottom groove walls 17,18 also be substantially straight in the regions where the great majority of the platform is located.

The substantially straight top and bottom groove walls and substantially straight top and bottom platform walls are closely adjacent each other throughout the majority of the illustrated neck, but not at the region of the neck that is relatively adjacent to butt end 12. The region of the groove that is relatively adjacent to butt end 12 is numbered 16*a* and is next described.

Referring particularly to FIG. 2, in the present preferred lever and tension system that adjusts the neck 10 in both directions the main body of groove 16 (in which the upper and lower groove walls are closely adjacent the top and bottom platform walls) extends from the head end 11 to a pivot point 37 on bottom wall 18 of groove 16. Such pivot point 37 is shown (for example) in FIG. 2. This is the pivot point that operates when compression is applied by actuating means 28.

Starting at pivot point 37, and continuing therefrom for a substantial distance toward head end 11 of the neck, such substantial distance being substantially greater than the distance from pivot point 37 to hinge 23, the bottom groove wall inclines gradually downwardly and toward the right (FIG. 2) to a corner 38. The indicated portion at the bottom groove wall (extending from pivot point 37 to corner 38) is indicated at 18*a* in FIG. 2. Starting at corner 38, the bottom groove wall no longer inclines downwardly but instead inclines substantially upwardly and toward the right to a region 39 that is near the actuating means 28. The indicated portion of the bottom groove wall between corner 38 and the region near actuating means (39) is shown at 18*b* in FIG. 2.

Figure 7:
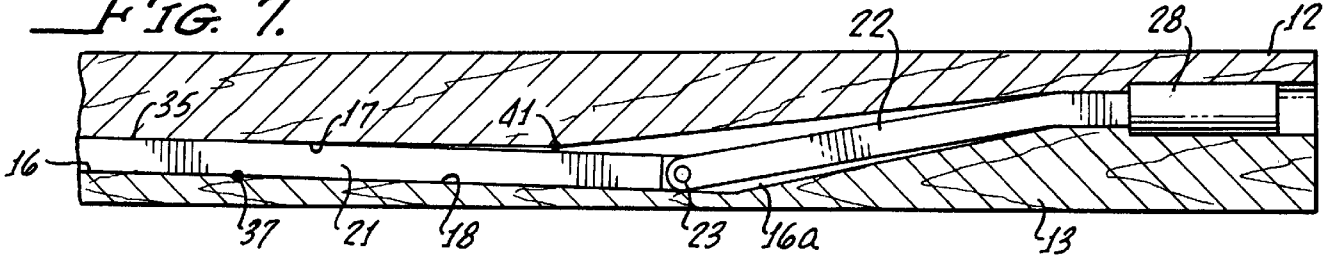
FIG. 7 is a view corresponding generally to FIG. 2 but exaggerated and showing the lever system in compression.

When actuating means 28 is operated to exert compression on driver 22 and thus on platform 21, the region of platform 21 to the right of pivot point 37 (FIG. 2) pivots downwardly as shown in FIG. 7. Platform 21 thus acts as a first-class lever by pivoting clockwise about pivot 37 from the FIG. 2 position to the FIG. 7 position. (A first-class lever is defined as one where the force is applied at one end, the fulcrum is in the middle, and the resistance-load is at the other end.) Because the platform 21 is quite rigid, the platform portion to the left (toward head end 11) of pivot point 37 remains relatively straight and pivots upwardly to exert upward force on the stop block 29 or pin 31. This compensates for any bowing of the neck 10 in an upward direction to cause the frets to be too close to the strings. Such upward bowing results from (for example) changes in moisture, and is not a frequent occurrence in comparison to the condition where the upper surface of the neck bows downwardly in response to (for example) string tension as described below.

It is to be understood that the portions 18*a*,18*b* of the bottom wall of the groove are so located as to permit the indicated lever action when compression is applied to the hinge and the platform. The lever action is caused to continue until the desired adjustment is achieved.

Referring again to FIG. 2, there is a second pivot point—numbered 41—that comes into play when tension is applied to driver 22 and thus to platform 21. Such second pivot point 41 is spaced toward butt end 12 from the first-mentioned pivot point 37. The second pivot point is on the top wall 17 of groove 16.

Figure 3:
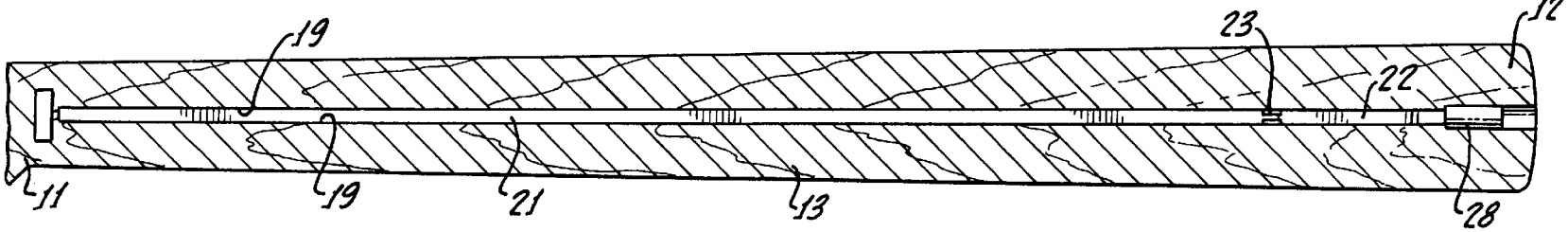
FIG. 3 is a horizontal section taken at the lever system.

Starting at second pivot point 41, the top wall of groove 16 inclines upwardly and toward the right until it reaches a region near actuating means 28 (FIG. 3). Such portion of top wall 17 is indicated at 17*a* in FIG. 2. It is sufficiently far from the platform 21 to permit the lever action (stated below) when tension is applied to the driver and platform.

When operation of actuating means 28 causes application of such tension, the portion of platform 21 to the right of second pivot point 41 (that is to say toward butt end 12) moves upwardly to cause pivoting of the platform about pivot point 41. This is again a first-class lever action and causes the region of platform 21 that is between pivot point 41 and head end 11 of the guitar to pivot downwardly (counterclockwise in FIG. 3) in order to compensate for bowing of the neck (the upper neck surface being somewhat concave) resulting from such factors as string tension. The stop block 29 (or pin 31) is moved downwardly by the described lever action.

As is the case with downward pivoting of the right end of the platform 21, upward pivoting thereof is sufficiently far to achieve the desired neck adjustment. The spacing of top wall portion 17*a* from the platform (when in the rest position of FIG. 3) is sufficient to permit the desired degree of neck adjustment.

It is to be understood that the regions 18*a*,18*b* of bottom wall 18, and the region 17*a* of top wall 17, may be spaced (FIG. 2) further from the platform and driver than is shown in such FIG. 2. However, it is preferred that there be minimum spacing necessary for the desired lever action.

BRIEF SUMMARY OF OPERATION

Figure 6:
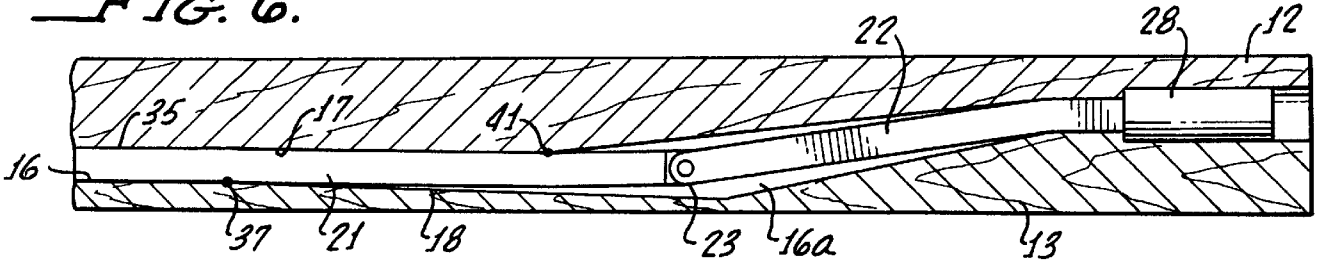
FIG. 6 is a view corresponding generally to FIG. 2 but exaggerated and showing the lever system in tension.

Assuming that the neck is one where the actuating means shown and described relative to FIG. 3 of the cited U.S. Pat. No. 4,557,174 is employed as the actuating means 28, let it first be assumed that the situation is a typical one where the string tension (for example) has caused downward bowing of the neck so that the distance between frets and strings is more than that desired for excellent playability. The person working on the guitar in the factory, or the musician adjusting the guitar long after purchase, merely inserts a wrench into the nut (numbered 38 in FIG. 3 of U.S. Pat. No. 4,557,174) and rotates the nut in a direction to urge driver 22 toward the right in FIG. 2 of this present patent application, thereby applying tension to the driver, to hinge 23, and to platform 21. The platform portion to the right of second pivot point 41 then pivots upwardly (counterclockwise) to or toward the position shown (exaggerated) in FIG. 6, the amount of pivotal movement being caused to be just sufficient to make the neck straighten sufficiently that the playability is brought to the desired high value. As above described, the stated pivotal action causes the stop block 29 or pin 31 to pivot downwardly and thus achieve the desired straightening action. After the neck is in its desired condition, the actuating means 28 is left alone, as are the driver and platform.

In the event the conditions become such (caused, for example, by moisture changes) that the neck bows upwardly so that the frets are too close to the strings, the assembler at the factory, or the musician subsequently, again inserts a wrench into the nut (FIG. 3 of the cited patent) and rotates such nut in the opposite direction in order to apply compression to the driver and the platform. The portion of the platform to the right of pivot 37 then pivots downwardly (clockwise) toward or to the position shown in FIG. 7. This compensates for the stated condition.

MISCELLANEOUS

In the present patent application the standard convention is adopted that the neck is disposed horizontally with its fingerboard (fretboard) uppermost, the fingerboard and frets being in substantially a horizontal plane.

Each pivot "point" is actually in the preferred embodiment a horizontal line, since the top and bottom walls 17,18 of groove 16 are formed straight across.

There may be a hard element region provided at each pivot point, for example a metal or synthetic resin insert, but this is not normally necessary.

The present system is preferably employed in a laminated wooden-graphite-synthetic resin neck described and claimed in a patent application filed on even date herewith and having the same inventor as the present application.

It is to be understood that the present system may also be employed without the compression action. In other words, it may be a "tension only" system that compensates for downward bowing of the fret board. However, the present double-action system is preferred.

The foregoing detailed description is to be clearly understood as given by way of illustration and example only, the spirit and scope of this invention being limited solely by the appended claims.

What is claimed is:

1. A guitar neck, which comprises:

(a) an elongate body, (b) a combination tension and lever system having platform and driver rotatably and pivotally coupled to each other along a common axis for adjusting the degree of straightness of said elongate body in response to application of tension to said system with consequent lever action of said system, and (c) actuating means to apply tension to said system.

2. The guitar neck of claim 1, wherein said combination tension and lever system includes platform situated within an internal groove of said elongate body, and pivotally coupled to a driver in a manner that said platform pivots about a region located on a top wall of said groove in response to said tension being applied to said driver.

3. The guitar neck of claim 2, wherein said platform includes an end that applies a downward force to said elongated body in response to said tension force being applied to said driver.

4. The guitar neck of claim 1, wherein said combination tension and lever system includes platform situated within an internal groove of said elongate body, and pivotally coupled to a driver in a manner that said platform pivots about a region located on a bottom wall of said groove in response to a compression force applied to said driver.

5. The guitar neck of claim 4, wherein said platform includes an end that applies an upward force to said elongated body in response to said compression force being applied to said driver.

6. A guitar neck, comprising:

an elongated body including a groove situated longitudinally within said elongated body;

an elongated platform situated longitudinally within said groove; and a driver situated within said groove and rotatably and pivotally coupled to said elongated platform along a common axis for causing said platform to forcibly act on said elongated body to adjust the straightness of said elongated body.

7. The guitar neck of claim 6, further including an actuating mechanism for applying a force to said driver to cause said platform to forcibly act upon said elongated body.

8. The guitar neck of claim 6, wherein said platform is configured within said groove in a manner that said platform pivots about a region located on a top wall of said groove in response to a tension force being applied to said driver.

9. The guitar neck of claim 8, wherein said platform includes an end that applies a downward force to said elongated body in response to said compression force being applied to said driver.

10. The guitar neck of claim 6, wherein said platform is configured within said groove in a manner that when a compression force is applied to said driver, said platform pivots about a region located on a bottom wall of said groove.

11. The guitar neck of claim 10, wherein said platform includes an end that applies an upward force to said elongated body in response to said compression force being applied to said driver.

12. The guitar neck of claim 6, wherein said platform includes an end having threads configured to mate with a threaded bore formed through a stop block located proximate a head end of said elongated body.

13. The guitar neck of claim 6, wherein said platform includes an end having a pin configured to mate with a block located proximate a head end of said elongated body.

14. A guitar neck, comprising:

an elongated body including a groove situated longitudinally within said elongated body;

an elongated platform situated longitudinally within said groove; and a driver rotatably and pivotally coupled to said elongated platform along a common axis for causing said platform to forcibly act on said elongated body to adjust the straightness of said elongated body.

15. The guitar neck of claim 14, further including an actuating mechanism for applying a force to said driver to cause said platform to forcibly act upon said elongated body.

16. The guitar neck of claim 14, wherein said platform is configured within said groove in a manner that said platform pivots about a region located on a top wall of said groove in response to a tension force being applied to said driver.

17. The guitar neck of claim 16, wherein said platform includes an end that applies a downward force to said elongated body in response to said compression force being applied to said driver.

18. The guitar neck of claim 14, wherein said platform is configured within said groove in a manner that when a compression force is applied to said driver, said platform pivots about a region located on a bottom wall of said groove.

19. The guitar neck of claim 18, wherein said platform includes an end that applies an upward force to said elongated body in response to said compression force being applied to said driver.

20. The guitar neck of claim 14, wherein said platform includes an end having threads configured to mate with a threaded bore formed through a stop block located proximate a head end of said elongated body.

21. A guitar neck, comprising:

an elongated body including a groove situated longitudinally within said elongated body;

an elongated platform situated longitudinally within said groove; and a driver situated within said groove and pivotally coupled to said elongated platform for causing said platform to forcibly act on said elongated body to adjust the straightness of said elongated body, wherein said platform is configured within said groove in a manner that said platform pivots about a region located on a top wall of said groove in response to a tension force being applied to said driver.

22. The guitar neck of claim 21, wherein said platform includes an end that applies a downward force to said elongated body in response to said compression force being applied to said driver.

23. A guitar neck, comprising:

an elongated body including a groove situated longitudinally within said elongated body;

an elongated platform situated longitudinally within said groove; and a driver situated within said groove and pivotally coupled to said elongated platform for causing said platform to forcibly act on said elongated body to adjust the straightness of said elongated body, wherein said platform is configured within said groove in a manner that when a compression force is applied to said driver, said platform pivots about a region located on a bottom wall of said groove.

24. The guitar neck of claim 23, wherein said platform includes an end that applies an upward force to said elongated body in response to said compression force being applied to said driver.

25. A guitar neck, comprising:

an elongated body including a groove situated longitudinally within said elongated body;

an elongated platform situated longitudinally within said groove; and a driver pivotally coupled to said elongated platform for causing said platform to forcibly act on said elongated body to adjust the straightness of said elongated body, wherein said platform is configured within said groove in a manner that said platform pivots about a region located on a top wall of said groove in response to a tension force being applied to said driver.

26. The guitar neck of claim 25, wherein said platform includes an end that applies a downward force to said elongated body in response to said compression force being applied to said driver.

27. A guitar neck, comprising:

an elongated body including a groove situated longitudinally within said elongated body;

an elongated platform situated longitudinally within said groove; and a driver pivotally coupled to said elongated platform for causing said platform to forcibly act on said elongated body to adjust the straightness of said elongated body, wherein said platform is configured within said groove in a manner that when a compression force is applied to said driver, said platform pivots about a region located on a bottom wall of said groove.

28. The guitar neck of claim 27, wherein said platform includes an end that applies an upward force to said elongated body in response to said compression force being applied to said driver.

* * * * *